US009091470B2

(12) United States Patent
Larsen

(10) Patent No.: US 9,091,470 B2
(45) Date of Patent: Jul. 28, 2015

(54) COOLING SYSTEM AND A METHOD FOR SEPARATION OF OIL

(71) Applicant: Danarctica ApS, Kalundborg (DK)

(72) Inventor: Flemming Clarence Larsen, Kirke Eskilstrup (DK)

(73) Assignee: Danarctica ApS, Kalundborg (DK)

( * ) Notice: Subject to any disclaimer, the term of this patent is extended or adjusted under 35 U.S.C. 154(b) by 0 days.

(21) Appl. No.: 14/383,955

(22) PCT Filed: Mar. 5, 2013

(86) PCT No.: PCT/DK2013/050057

§ 371 (c)(1),
(2) Date: Sep. 9, 2014

(87) PCT Pub. No.: WO2013/131522

PCT Pub. Date: Sep. 12, 2013

(65) Prior Publication Data

US 2015/0052915 A1 Feb. 26, 2015

(30) Foreign Application Priority Data

Mar. 9, 2012 (DK) ..... 2012 70104

(51) Int. Cl.

| | |
|---|---|
| ***F25B 43/02*** | (2006.01) |
| ***F25B 31/00*** | (2006.01) |
| ***F25B 1/00*** | (2006.01) |
| *F25B 39/04* | (2006.01) |

(52) U.S. Cl.

CPC ..... *F25B 43/02* (2013.01); *F25B 1/005* (2013.01); *F25B 31/004* (2013.01); *F25B 39/04* (2013.01)

(58) Field of Classification Search

CPC ..... F25B 39/04; F25B 31/002; F25B 43/02; B01D 1/0041; B01D 1/0047; B01D 1/0052; F28D 2021/0049; F28D 2021/0089

See application file for complete search history.

(56) References Cited

U.S. PATENT DOCUMENTS

| | | | | | |
|---|---|---|---|---|---|
| 1,620,713 | A | * | 3/1927 | Bell | 165/111 |
| 3,822,567 | A | * | 7/1974 | Kasahara | 62/473 |
| 4,809,520 | A | | 3/1989 | Manz et al. | |
| 5,419,155 | A | * | 5/1995 | Boehde et al. | 62/470 |

FOREIGN PATENT DOCUMENTS

| | | | |
|---|---|---|---|
| CN | 201096430 | Y | 8/2008 |
| CN | 202013056 | U | 10/2011 |
| JP | 2005-127542 | A | 5/2005 |
| WO | 94/23252 | A1 | 10/1994 |
| WO | 2007/068247 | A1 | 6/2007 |

* cited by examiner

*Primary Examiner* — Frantz Jules
*Assistant Examiner* — Erik Mendoza-Wilkenfel
(74) *Attorney, Agent, or Firm* — Roberts Mlotkowski Safran & Cole, P.C.; David S. Safran

(57) ABSTRACT

The invention relates to a cooling system (2) and a method for oil separation, where a condenser unit (10) contains an oil separator (18,20), from which oil separator oil is lead through a pipeline (24) and back to the compressor (4). It is an object of the invention to collect all condensing functions and oil separation functions into a common pressure container (26). According to the invention, this objective is achieved by a system, the condenser unit and oil separator are integrated in a common pressure tank (26) that contains at least one first oil separator and at least a second secondary oil separator, which pressure tank contains a condenser container (30) which interacts with a third oil separator (22). Hereby, it is attained that condensation and oil separation are integrated in a common pressure tank.

10 Claims, 2 Drawing Sheets

COOLING SYSTEM AND A METHOD FOR SEPARATION OF OIL

TECHNICAL FIELD

The present invention relates to a cooling system and a method for separation of oil.

BACKGROUND OF THE INVENTION

WO2007/068247 (Oil Management System filed by York Denmark ApS, Denmark) describes a method and a system for controlling and regulating an oil supply, wherein a common pressure housing contains all functions for the treatment of oil with aim of processing a mixture of oil and a cooling agent that leaves the compressor thereby to separate the oil and return it to the compressor. The pressure housing contains the following components in relation to the processing of the oil: an oil separator from which oil flows to an oil sump, an oil cooler connected to the oil sump, a mixing valve in which oil from the oil cooler is mixed with oil from the oil sump in order to obtain an optimal oil temperature, and an oil filter for filtering the mixed oil that is subsequently returned from the oil filter to the compressor.

In particular, the above-mentioned components can function at a pressure that is approximately equal to the exit pressure from the compressor.

Furthermore, JP 2005 127542 A describes a cooling system comprising at least one compressor that has at least one suction inlet and at least one pressure outlet, where the system further comprises at least one condenser unit that via a cooling agent line is connected to at least one restriction element, which element has connection to at least one evaporator connected to the suction inlet of the compressor, wherein the condenser unit comprises at least one oil separator from which oil is returned through a pipeline to the compressor, and wherein the condenser unit and the oil separator are integrated in a common pressure tank. In this system, the pressure tank does not contain an oil sump or a condenser container which is cooled by means of a heat exchanger, through which flows a first cooling agent. Furthermore, this system does not comprise an interaction between the condenser container and an oil cooler, that is placed in connection with the condenser container and where a liquid and gas connection is established between the bottom portion of the condenser container and the oil cooler, and wherein oil from the oil sump at the bottom of the common pressure tank is lead through the heat exchanger of the oil cooler and back to the compressor.

THE OBJECT OF THE INVENTION

It is an object of the present invention to integrate all condensation functions and oil separation functions in a common pressure container.

It is a further object of the present invention to provide a very compact cooling system.

SUMMARY OF THE INVENTION

The above and other objects are attained according to the invention with a system as described in the preamble of claim 1 according to which the condenser unit and the oil separator are integrated in a common pressure tank, which pressure tank comprises at least one oil sump, which pressure tank comprises a condenser container that is cooled by a heat exchanger, through which heat exchanger a first cooling agent is flowing, and where the condenser container interacts with an oil cooler formed as a container placed in connection with the condenser container, and wherein there is established a liquid and gas connection between the condenser container and the oil cooler, and wherein oil is lead from the oil sump at the bottom portion of the common pressure tank through the heat exchanger of the oil cooler and back to the compressor.

By the above means it is attained that condensation, oil separation and oil cooling become integrated in a common pressure tank, such that the individual components within the pressure tank can be formed of relatively thin material due to the fact that approximately the same pressure is present throughout the pressure tank. Especially, if the compressor is a screw compressor, it is to be expected that a relatively large amount of oil is separated together with the cooling agent. Therefore, oil separation and oil cooling are strictly necessary, and a continuous return of oil to the screw compressor will be necessary. Return of oil to a screw compressor can be accomplished relatively simple by leading the oil into the cooperating screws at a position where the pressure is, in fact, lower than the pressure that exists during oil separation. By these means, a suction effect can be obtained such that the return oil is automatically sucked back to the screw compressor.

By integrating oil separation, condensing and oil cooling in a common pressure tank, a very compact design of a cooling system is obtained. Liquid cooling agent can be lead directly from the pressure tank to one or more evaporators. Likewise, a heat exchanger placed in the condenser tank can be cooled directly by a medium, for instance water, flowing through the tank. Especially, in case of a multi step oil separation there is obtained a very effective oil separation in the pressure tank. A first oil separator takes up by far the largest amount of oil because all larger oil drops are automatically taken up and combined and then flow down into the oil sump. It is important that these large oil drops are taken up before the cooling agent with mixed-in oil passes through a second oil separator because this oil separator is normally provided with a very fine mesh that would rapidly be completely blocked up if larger oil particles were present in the cooling agent.

Due to the fact that the larger oil drops have already been removed in the first oil separator, such that only a few percent of the entire amount of oil are left, a highly effective oil separation in the second oil separator is obtained. The last oil separation takes place in connection with actual condensation of the cooling agent. Tiny oil drops that may still flow together with the gaseous cooling agent will automatically end in the liquid cooling agent where the oil has another density than the cooling agent, after which the oil can be separated. Especially, if the cooling agent has a lower density than the oil, the cooling agent can be drawn off above the actual bottom level of the cooling agent. By these means, collection of oil below the bottom level of the cooling agent can be accomplished. Consequently, this oil can be drawn off and returned to the compressor.

According to a first aspect of the invention, a cooling system comprising at least one compressor is provided, where the compressor comprises at least one suction inlet and at least one pressure outlet and at least one condenser unit which, via a cooling agent line, is connected to at least one restriction element, which element is connected to at least one evaporator that is in connection with the suction inlet of the condenser unit, wherein the condenser unit contains at least one oil separator, from which oil separator oil can be lead through a pipeline back to the compressor.

An oil cooling agent mixture with concentration increased by evaporation of cooling agent in the oil cooler container is drawn off through at least one valve and returned to the compressor. Only a very small amount of oil is involved which means that the valve only has to be opened briefly and with very long time intervals there between. Thereby, the oil level in the oil cooler tank is kept low, such that the heat exchanger in the oil cooler is completely surrounded by cooling agent.

The oil cooler can be integrated in the container. By integrating the oil cooler in the existing condenser tank, a still more compact design of the system can be obtained. A supply of cooling agent to the oil cooler tank is necessary, but this can take place via appropriate tubing.

The heat exchanger can be cooled by the first cooling agent that flows through the heat exchanger. The heat exchanger contains a plurality of tubes through which flows the first cooling agent. Advantageously, the condenser unit itself can be formed as a string of longitudinally extending tubes through which flows the first cooling agent, such that condensing is accomplished by the passage of the gas between the tubes. A further cooling of the liquid cooling agent, before it leaves the condenser unit, can provide an increased efficiency of the entire cooling system.

The heat exchanger is cooled by the first cooling agent flowing through the heat exchanger. The heat exchanger is formed as a plate heat exchanger. Alternatively to using a plurality of tubes, a plate heat exchanger can be used. Plate heat exchangers provide a very large surface for heat exchange between primary and secondary media.

Advantageously, the cooling system can be applied as a heat pump system. The condenser heat can be used for heating. A heat pump system using the present invention will be highly efficient because the heat that is produced by cooling of the oil together with the condenser heat will be transferred to the medium that flows through the condenser heat exchanger.

Alternatively, the present invention can be used for cooling. The cooling system can be designed for high efficiency because both the cooling agent and the oil are cooled efficiently.

The cooling system can form a combined cooling and heat pump system. Advantageously, the present invention can be used either as a cooling system or a heat pump system or as a combination of both systems. The first cooling agent used for condensation will receive a comparatively large quantity of heat and, dependent on the pressure conditions, a heating to between 50 and 70 degrees centigrade can be accomplished. Therefore, this condensing heat can be applied for instance for hot water production or room heating. Likewise, condensed cooling agent will be produced in such a quantity that a bigger cooling system can be used. An alternative possibility is to use this system in a larger aid conditioning system.

The condenser container and the oil cooler container can be integrated in a common housing that is contained within a pressure supporting container. Thereby, the condenser container and the oil container can be constructed as a common unit that is exposed to approximately equal pressure internally and externally.

According to a second aspect, the present invention also relates to a method for oil separation, condensation and oil cooling in a system, wherein oil separation, condensation and oil cooling take place in a sequence of process steps:

(a) compressed cooling agent is applied to the pressure tank;
(b) the cooling agent passes through the first internal face of the pressure tank and the external face of the of the condenser tank;
(c) the cooling agent with a residue of oil is sucked into the condenser container;
(d) the cooling agent with a residue of oil is condensed by heat exchange with a first cooling agent;
(e) oil is separated, whereby an increase of concentration of oil in the oil cooler container takes place;
(f) condensed cooling agent flows out of the condenser container through the outlet;
(g) oil is lead from the oil sump through the heat exchanger of the oil cooler and pipeline and back to the compressor;
(h) cooling agent in the oil cooler container is evaporated by contact with the hot oil that flows in the oil cooler heat exchanger, whereby oil in the oil cooler heat exchanger is cooled; and
(i) evaporated cooling agent from the oil cooling is lead to the condenser heat exchanger, wherein the cooling agent is re-condensed.

By the above method, a highly efficient method for combining oil separation, condensation and oil cooling is obtained.

BRIEF DESCRIPTION OF THE DRAWINGS

The present invention will be better understood with reference to the drawings in conjunction with the following detailed description of the invention.

DETAILED DESCRIPTION OF THE INVENTION

Figure 1:
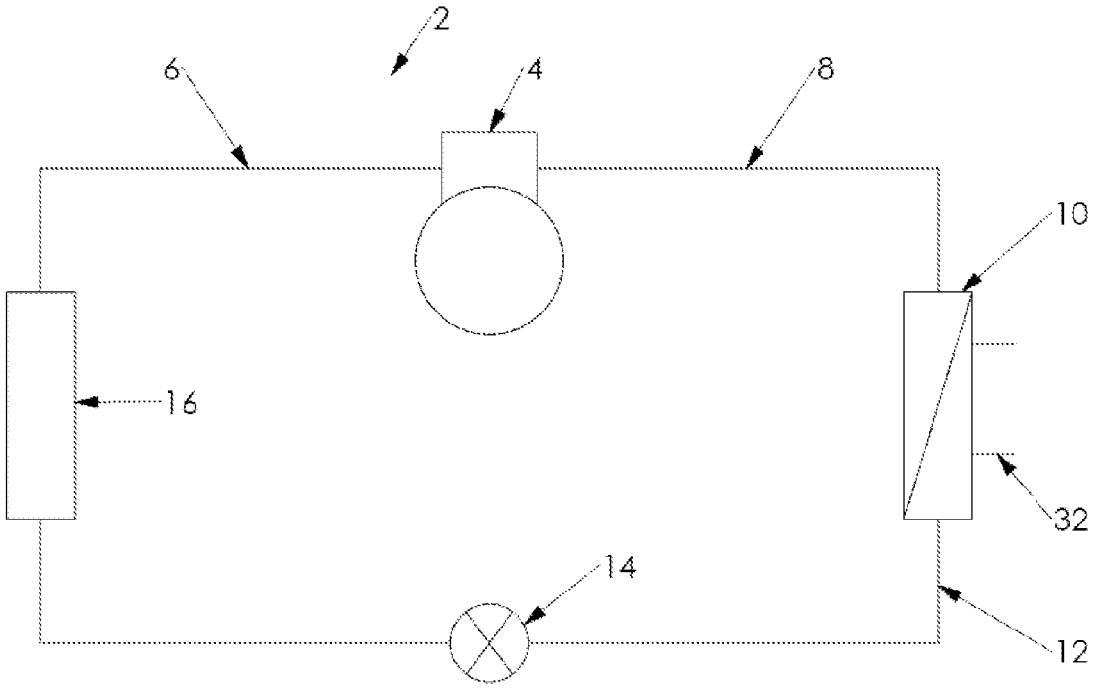
FIG. 1 shows a schematic representation of the invention.

With reference to FIG. 1, there is shown an embodiment of a cooling system 2 that comprises a compressor 4 with a suction line 6 and a pressure outlet 8. The pressure outlet 8 is connected to a condenser unit 10, in FIG. 1 shown as a heat exchanger that is provided with a connection 32 to an external cooling agent. From the condenser unit 10 liquid cooling agent is lead through a pipeline 12 to a restriction element 14 that can typically be formed as an expansion valve, from which expanded cooling agent is lead to at least one evaporator 16. This evaporator 16 is provided with a connection to the compressor's suction gas connection 6.

The compressor 4 sets the cooling agent under pressure such that gaseous cooling agent is sucked through the suction line 6 and leaves the compressor under a considerably higher pressure through a pressure outlet 8. There exist numerous different cooling compressors that can all in principle be represented by the shown compressor 4. Single or multiple piston compressors can be used as can scroll compressors or screw compressors. Additionally, it is for instance known from the field of automobile air conditioning to use piston compressors that are driven by a rotating inclined disc.

Cooling agent under high pressure is thus lead through a pressure outlet 8 and to the condenser unit 10. Here, a substantial cooling of the hot pressure gas will take place, such that the pressure gas becomes condensed to liquid. Liquid cooling agent leaves the condenser unit through the connection 12 and reaches the restriction element 14. There are many different forms of restriction elements. Traditionally, capillary tubes are applied in smaller cooling systems, whereas automatic expansion valves are applied for larger cooling systems.

Some expansion valves are controlled by the super heating of the evaporator 16 by a feedback of the measured pressure or temperature at the outlet of the evaporator to the expansion valve 14 such that a super heating is ascertained for protection of the compressor. Other expansion valves are electronically controlled and very sophisticated control algorithms are used to obtain optimal flow of cooling agent through evaporators. The cooling agent leaves the restriction element 14 and passes through one or more evaporators 16. It is understood that a large number of expansion valves 14 can be present acting in parallel and each controlling one or more evaporators. Evaporators exist in many different forms and in the evaporator the cooling agent is heated such that the cooling agent evaporates. Sometimes, flooded evaporators are applied where the evaporators are completely filled with liquid and the cooling agent is boiling inside the evaporator, and only gaseous cooling agent is sucked back to the compressor. This leads to the risk of collecting oil at the bottom of a flooded evaporator, and either a system for oil removal is required or a highly efficient oil separation as obtained according to the present invention.

Figure 2:
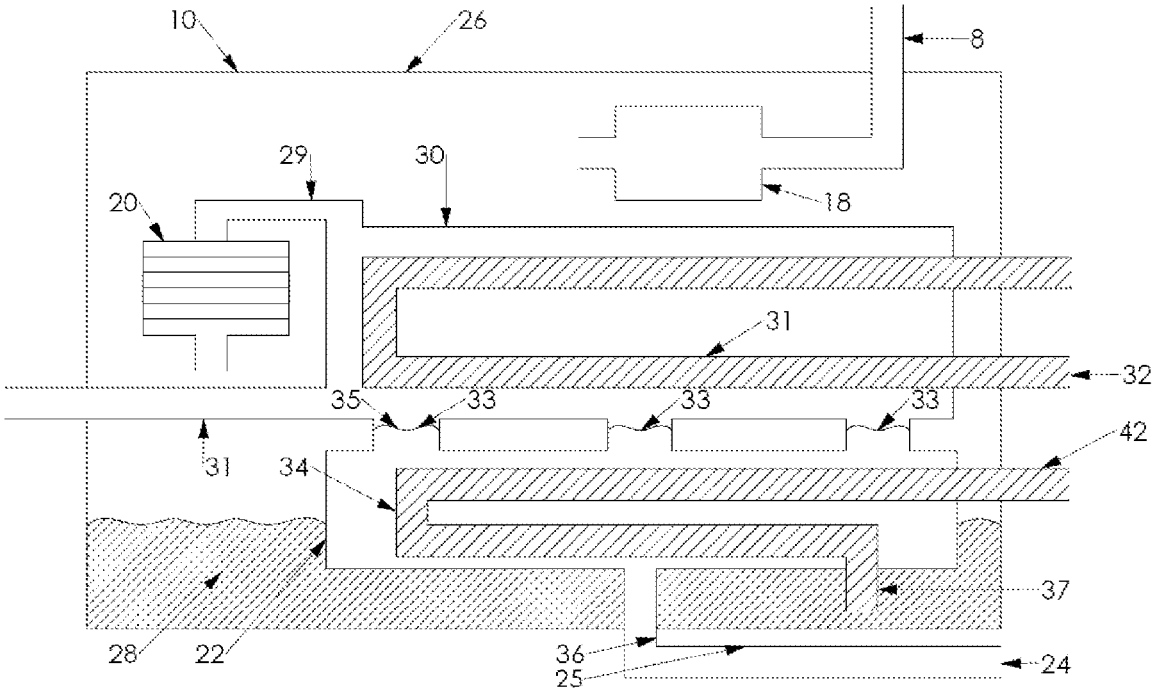
FIG. 2 shows a first embodiment of a combined condenser and oil separation unit.

With reference to FIG. 2, a combined unit for oil separation, condensation and oil cooling is shown. FIG. 2 shows a condenser unit 10 provided within a common pressure tank 26. The pressure tank may contain a first oil separator 18 and a subsequent oil separator 20. The oil cooler container 22 is shown without the condenser tank. The oil is collected in an oil sump 28, where oil through a connecting piece 37 is sucked through the oil cooler heat exchanger 34 before the oil is returned to the compressor through a pipeline 42. The cooling agent is sucked through the secondary oil separator 20 through a suction line 29 into a condenser container 30.

The condenser container contains a heat exchanger that may be formed as a cooling helix 31 through which flows an external cooling agent 32. Within the condenser unit 30, a liquid level 35 is indicated. Liquid cooling agent leaves the condenser unit 30 through a pipeline 31 wherein liquid cooling agent can be lead towards a flow-restriction unit, typically in the form of an expansion valve. Simultaneously with condensing of the cooling agent in the condenser container 30, the gaseous oil that may still be present in the cooling agent will likewise condense. Oil has greater density than the cooling agent and consequently sinks towards the bottom of the condenser container 30, where the oil and the cooling agent through openings 33 fill up an oil cooler tank 22. From the oil cooler tank 22, oil can be drawn off through the pipeline 24, possibly through a valve 25.

By the application of the present invention as described, the oil can be cooled to an optimal temperature for suction into a screw compressor. If the oil is introduced in the screw compressor in the vicinity of the inlet of the suction gas, the oil will be sucked automatically into the compressor.

The oil should be so cold that the oil does not heat the suction gas because an expansion of the cooling agent reduces the efficiency of the compressor.

With a further cooling of the oil, before the oil is returned to the compressor, it is possible to adapt the oil temperature to the optimal temperature in relation to for instance a screw compressor. Choice of oil temperature for a screw compressor is always associated with several compromises. The oil must have sufficiently high temperature to have good lubrication characteristics, but at the same time so low a temperature that unnecessary heating of the cooling agent does not take place, which will lead to expansion of the cooling agent and to a reduction of the efficiency of the compressor. It will be possible by a controlled mixing of the cooled oil and hot oil drawn off from the oil sump to obtain a perfect temperature for a screw compressor.

The invention claimed is:

1. Cooling system comprising at least one compressor, which compressor has at least one suction inlet and at least one suction outlet, which cooling system comprises at least one condenser unit, which condenser unit via a cooling agent line is connected to at least one restriction element, which restriction element is connected to at least one evaporator, where the condenser unit contains at least one oil separator from which oil separator oil is lead through a pipeline back to the compressor, characterized in that the condenser unit and the oil separator are integrated into a common pressure tank, which pressure tank contains at least one oil sump, where the pressure tank contains a condenser container, which condenser container is cooled by a heat exchanger extending into the condenser container, through which heat exchanger there flows a first cooling agent, where the condenser container comprises in part an oil cooler having a heat exchanger extending into said part of the condenser container, where a liquid and gas connection is establish between the bottom of the condenser container and the oil cooler, from which said at least one oil sump oil at the bottom of the common pressure tank is lead through said heat exchanger of the oil cooler and back to the compressor.

2. Cooling system according to claim 1, characterised in that an oil cooling agent mixture, the concentration of which has been increased by evaporation of cooling agent in the oil cooler container, is lead through at least one valve and back to the compressor.

3. Cooling system according to claim 2, characterised in that the oil cooler is integrated in the condenser container.

4. Cooling system according to any of the preceding claims 1 characterised in that the heat exchanger is cooled by cooling agent flowing through the heat exchanger, which heat exchanger contains one or more tubes through which cooling agent is flowing.

5. Cooling system according to claim 1, characterised in that the heat exchanger is cooled by a cooling agent flowing through the heat exchanger, which heat exchanger is formed as a plate heat exchanger.

6. Cooling system according claim 1, characterised in that the cooling system forms a heat pump system.

7. Cooling system according to claim 1, characterised in that the cooling system is constructed to function as a freezer.

8. Cooling system according to claim 1, characterised in that the cooling system forms a combined cooling and heat pump system.

9. Cooling system according to claim 1, characterised in that the condenser container and the oil cooler container are integrated in a common housing that is contained in a pressure supporting container.

10. Method for condensation, oil separation and oil cooling in a cooling system comprising at least one compressor, which compressor has at least one suction inlet and at least one suction outlet, which cooling system comprises at least one condenser unit, which condenser unit via a cooling agent line is connected to at least one restriction element, which restriction element is connected to at least one evaporator, where the condenser unit contains at least one oil separator from which oil separator oil is lead through a pipeline back to the compressor, characterized in that the condenser unit and the oil separator are integrated into a common pressure tank, which pressure tank contains at least one oil sump, where the pressure tank contains a condenser container, which condenser container is cooled by a heat exchanger, through which heat exchanger there flows a first cooling agent, where the condenser container interacts with an oil cooler, which oil cooler is placed in connection with the condenser container, where a liquid and gas connection is established between the bottom of the condenser container and the oil cooler, from which oil sump at the bottom of the common pressure tank oil is lead through the heat exchanger of the oil cooler and back to the compressor; wherein oil separation, condensation and oil cooling take place in a sequence comprising the following steps:

(a) compressed cooling agent is lead into the pressure tank;

(b) the cooling agent passes the internal face of the pressure tank and the external face of the condenser tank;

(c) the cooling agent with an oil residue is sucked into the condenser tank;

(d) the cooling agent with the oil residue is condensed by heat exchange with the first cooling agent;

(e) oil is separated, whereby an increase of concentration of oil in the oil cooler container takes place;

(f) condensed cooling agent flows out of the condenser tank through the outlet;

(g) oil is lead from the oil sump through the heat exchanger and the pipeline and back to the compressor;

(h) the cooling agent in the oil cooler container is evaporated by contact with the hot oil that flows in the heat exchanger, whereby oil in the heat exchanger is cooled; and (i) evaporated cooling agent from oil cooling is lead to the condenser heat exchanger in which the cooling agent is re-condensed.

* * * * *